US005622296A

United States Patent [19]

Pirhonen et al.

[11] Patent Number: 5,622,296

[45] Date of Patent: Apr. 22, 1997

[54] RELEASABLE SWIVEL HOLDER FOR PERSONAL ARTICLES

[76] Inventors: Ilkka Pirhonen, 2308 Sawtelle Blvd., Los Angeles, Calif. 90064; Taisto Korjansalo, 08150 Lohja, Finland

[21] Appl. No.: 568,394

[22] Filed: Dec. 6, 1995

[51] Int. Cl.[6] ..... A45F 5/00

[52] U.S. Cl. ..... 224/197; 224/272; 224/483; 24/597; 24/665; 248/225.11

[58] Field of Search ..... 224/197, 198, 224/199, 200, 272, 483, 665, 929; 24/3.6, 3.11, 3.12, 590, 597, 666, 669, 663, 664, 665; 248/225.11, 222.11, 224.61, 222.13, 223.41; 403/321, 325, 326, 327, 329

[56] References Cited

U.S. PATENT DOCUMENTS

| | | | |
|---|---|---|---|
| 1,519,380 | 12/1924 | Kochanski | 24/669 |
| 2,502,034 | 3/1950 | Bowie | 24/669 |
| 3,631,572 | 1/1972 | Lange | 24/665 |
| 4,419,794 | 12/1983 | Horton, Jr. et al. | 224/197 |
| 5,026,016 | 6/1991 | Lisowski | 248/225.11 |
| 5,054,170 | 10/1991 | Otrusina | 224/197 |
| 5,201,858 | 4/1993 | Otrusina | 224/197 |
| 5,274,885 | 1/1994 | Hellweg | 24/597 |
| 5,375,749 | 12/1994 | Oliva | 224/272 |

*Primary Examiner*—Henry J. Recla
*Assistant Examiner*—Gregory M. Vidovich
*Attorney, Agent, or Firm*—Roger A. Marrs

[57] ABSTRACT

A swivel holder is disclosed herein having a base member detachably carried from a belt, auto dash-board, wall surface or the like for releasably supporting an item or article of personal use. The article is provided with a stud and the base member includes guide rails defining a receptacle for insertably receiving the stud and for holding the stud in rotatable or swivelling relationship. A resilient catch member retains the stud in swivelling position on the base member and a finger latch mechanism controls the catch member for retention or release of the stud.

8 Claims, 1 Drawing Sheet

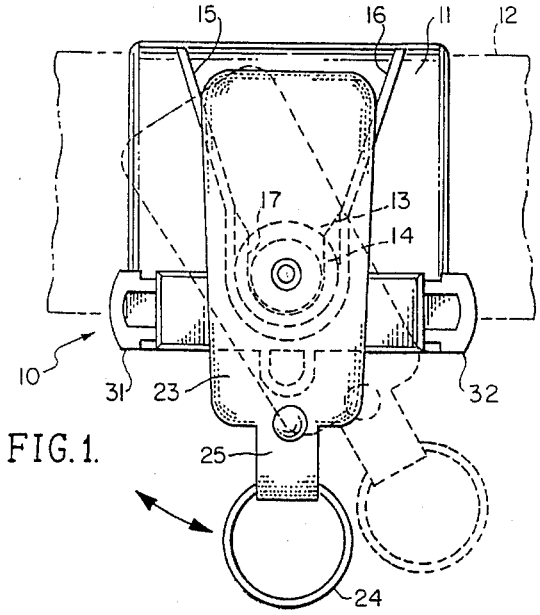
FIG. 1.
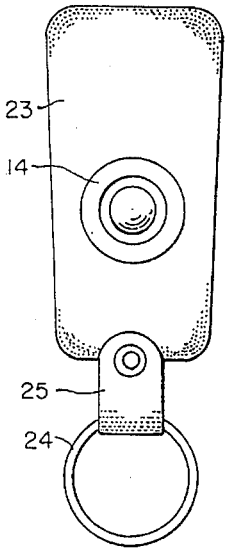
FIG. 2.
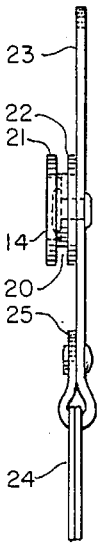
FIG. 3.
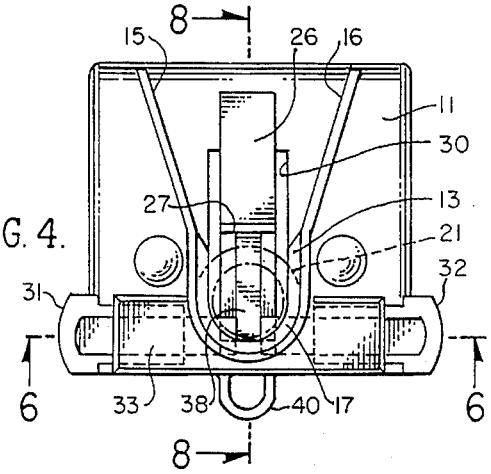
FIG. 4.
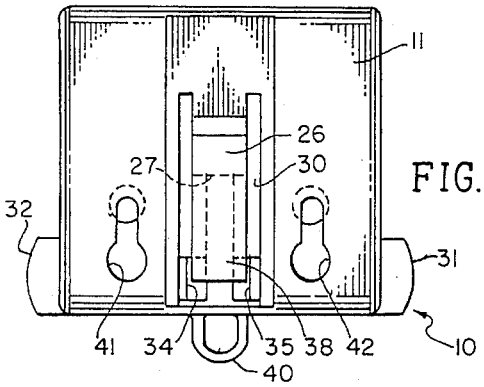
FIG. 5.
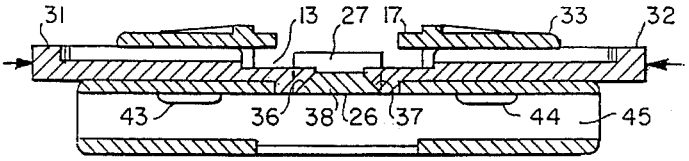
FIG. 6.
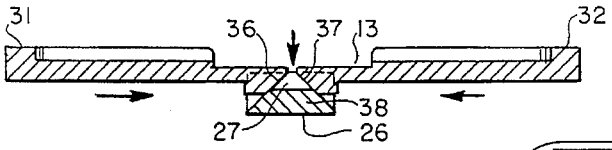
FIG. 7.
FIG. 8.
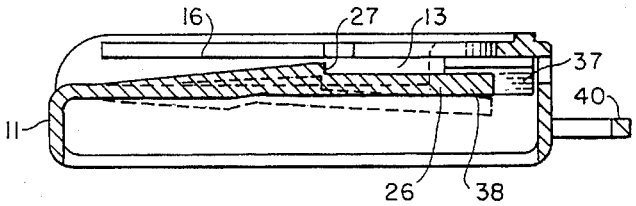

RELEASABLE SWIVEL HOLDER FOR PERSONAL ARTICLES

BACKGROUND OF THE INVENTION

1. Field of the Invention

The present invention relates to the field of personal article holders and more particularly to a holder having a swivel connection means for an article of personal use and a manually operated retention and release mechanism for detachably mounting the article with the holder.

2. Brief Description of the Prior Art

Presently, certain individual or personal use articles are wall mounted or carried on a person's belt in order that the article is immediately present when needed. Such belt carried articles, as an example, commonly have carrying Cases which themselves must be supported by the belt worn by the user. Personal telephone pager devices are an example of such an article.

With respect to personal paging articles carrying case or holders, such should be easily and quickly attachable to and also readily detachable from the belt. The connection between the case and the belt should be such as to be personally comfortable to the user or wearer.

Elongated articles which are belt supported usually require pivotal mountings so that, when the user sits down, the lower end of the device will not engage the seat or the arm of the chair. This sort of action requires a connection which not only permits attachment and detachment at will, but also arcuate or pivotal movement over a considerable angular distance while retaining attachment and securement to the belt.

Attempts have been made to provide suitable swivel attachment for such articles; however, problems and difficulties have been encountered which stem largely from the fact that attachment of the article is not positive nor convenient for release. The disclosure of U.S. Pat. 4,827,614 shows a release mechanism but no means for providing a swivel action. U.S. Pat. 4,718,586 discloses a swivel connection but does not provide for a quick release mechanism.

Therefore a long standing need has existed to provide a holder for a personal use article which combines both a quick release feature as well as a detachable swivel connection between the article and the holder.

SUMMARY OF THE INVENTION

Accordingly, the above problems and difficulties are avoided by the present invention, which provides a holder having a V-shaped receptacle defined by side rails for insertably receiving a stud carried on the personal use article. The Stud is undercut to provide a circular groove slidably accepting the side rails and permitting swivel action. A latch mechanism releasably connects between the holder and the stud for detachably coupling the personal use article with the holder while in an at rest position or a swivel position. The latch mechanism includes a resilient catch operable between a retention and a non-retention position by a finger operated pair of latches laterally mounted on the holder for selective engagement with the resilient stud.

Therefore, it is among the primary objects of the present invention to provide a holder for an article of personal use that permits selective positive and releasable retention of the article while allowing the article to swivel when in its retained condition.

Another object of the invention resides in providing a leterally actuated latch and catch mechanism in combination with a swivel mounting between a holder and an article of personal use that is convenient to use and may be operated manually with the fingers of one hand.

Another object of the present invention is to provide a novel holder for a personal item that includes a resilient catch and latch means for releasably retaining the item in swivelling or non-swivelling position with respect to the holder.

A further object resides in providing a holder for personal items that may be detachably mounted or carried on a belt, a wall surface or the dashboard of an auto so that the item may swivel while in place on the holder and so that the item may be releasably retained on the holder.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view of the novel swivel holder incorporating the present invention;

FIG. 2 is a front elevational view of the stud carried on the personal article intended to be mounted on the holder shown in FIG. 1;

FIG. 3 is a side elevational view of the stud shown in FIG. 2;

FIG. 4 is a view similar to the view shown in FIG. 1 without the stud;

FIG. 5 is a rear elevational view of the swivel holder;

FIG. 6 is a transverse cross sectional view of the latch mechanism as taken in the direction of arrows 6—6 of FIG. 4;

FIG. 7 is a view similar to the view of FIG. 6 showing the latch mechanism in a release condition; and FIG. 8 is a longitudinal section view as taken in the direction of arrows 8—8 of FIG. 4.

DESCRIPTION OF THE PREFERRED EMBODIMENT

Referring to FIG. 1, the novel swivel holder of the present invention is illustrated in the general direction of arrow 10 which includes a base member 11 that is carried on a belt 12 of the user. It is to be understood that the belt 12 is employed for illustrative purposes and the mounting of the holder may be placed against a flat or on an auto dashboard. The holder or base member 11 includes a receptacle 13 for insertably receiving a swivel stud 14 which is more clearly identified in FIG. 2. The stud 14 is carried on an item or article of personal use and is introduced to the receptacle 13 via a V-shaped guide defined by rails 15 and 16 respectively. The guide rails 15 and 16 terminate at the receptacle 13 to provide a U-shaped flange 17 adapted to be insertably received within a slot 20 defined between a stud upper plate 21 and a stud lower plate 22 as shown in FIG. 3. Once the stud 14 has been introduced to the receptacle via the guide rails 15 and 16 the flange 17 is introduced to the angular slot 20 and the stud will bottom-out in the receptacle. The stud is free to rotate or pivot as shown in broken lines in FIG. 1 once it has been captured on the flange 17 between the stud plates 21 and 22. The present illustration shows that the stud 14 is carried on a support 23 which in turn carries a ring 24 suitable for carrying keys or the like. A strap 25 secures the ring 24 to one end of the support 23. The stud 14 is fixed to the support 23; however, it is to be understood that the stud 14 may also be suitably affixed to the back side of a telephone pager or other electronic equipment which is intended to be detachably carried on the holder 11.

FIGS. 2 and 3 show the various components of the stud 14 and the suggestion as to the adherence of the stud to the article of personal use.

Referring now in detail to FIG. 4, the stud 14 is illustrated in broken lines (as being) within the receptacle 13 with the flange 14 inserted between the stud plates 21 and 22. Once the stud has been disposed in the receptacle, a leaf spring 26 is normally biased outward away from the base member 11 so that a catch 27 will be expanded over the inner or lower stud plate 22 so as to interfere with any withdrawal or removal of the stud from the receptacle. The catch 27 is urged by the normal spring bias of the leaf spring 26 to project over the stud. However, when the stud is passing between the guide rails 15 and 16 into the receptacle 13, the stud plate 21 urges the leaf spring 26 rearwardly to a slot 30 in the base member to permit the stud to pass beyond the catch 27 into the receptacle 13. Once the stud has progressed into the receptacle, the bias of the leaf spring 26 causes the catch 27 to come forward from the slot 30 and to engage with the outer or upper stud plate 21.

The catch 27 is removed from interfering with removal of the stud 14 from receptacle 13 by means of a latch release mechanism comprising a pair of slide elements 31 and 32 which move laterally within a passageway within a housing 33. The slide elements 31 and 32 move within the open-ended passage-way and are retained therein by projections 34 and 35 shown in FIG. 5. These projections operate within the lower end of slot 30 and prevent the elements 31 or 32 from leaving their sliding mounting in the passageway defined by housing 33.

Referring now in detail to FIG. 6, it can be seen that the opposing ends of the slide elements 31 and 32 include inclined tips 36 and 37 respectively. These inclined tips are urged in converging direction when the elements 31 and 32 are manually moved towards one another within the passageway defined by housing 33. Disposed between the inclined tips, there is provided a wedge element 38 having sloping sides against which the inclined tips ride when converged together. Upon engagement of the inclined tips with the wedge 38, the wedge, which is attached to the lower end of the leaf spring 26, is forcibly urging the leaf spring 26 into the position shown in FIG. 7. This action removes the catch 27 from interfering with removal of the stud from the receptacle 13.

Referring now in detail to FIG. 6, it can be seen that pushing the elements 31 and 32 together in the direction of the arrows produces a squeezing force on the wedge 38. Such a squeezing force causes the wedge 38 carried on the end of leaf spring 26 to move into the position shown in FIG. 7. Since the catch 27 is carried on the leaf spring 26, the catch is removed from the track or path on which the stud 14 travels and the catch is out of interference with the stud movement. Upon release of the elements 31 and 32, the leaf spring 26 urges separation of the elements and the elements return to their original position as shown in FIGS. 4–6 inclusive.

In FIG. 8, the catch 27 is shown in the track or pathway through which the stud 14 travels to reach the recess 13. This indication is in solid lines and represents the position when the elements 31 and 32 are in their relaxed and non-actuated position. When the elements are actuated and pressed towards one another, the leaf spring 26 retreats from the passageway into the position shown in broken lines and in so doing, carries the catch 27 rearwardly out of the passageway or track of movement for the stud 14.

It can be seen that the holder 11 may include a downwardly depending eyelet indicated by numeral 40 to which rings, keys or other articles may be attached. The eyelet is an auxilliary attachment point to be used at the option of the user. Also, the eyelet may be used for supporting the holder on a wall surface by means of a hook (not shown) that is installed on the wall. Another mode of mounting is to employ a pair of slots 41 and 42, as shown in FIG. 5, that may insertably receive mounting pins such as screws, nails or the like whereby the holder may be mounted on a flat wall or on the dashboard of an auto. For belt mounting, the holder 11 is provided with a pair of spacers 43 and 44 as shown more clearly in FIG. 6 so that as the belt passes through the open-ended passageway represented by numeral 45, the belt will be held a slight distance away from the wall surface of the holder carrying the leaf spring 26. By spacing the belt away from the wall surface, a space is provided between the belt and wall surface by the spacers 43 and 44 to permit the leaf spring 26 to move into the space without interfering with the belt. Should the belt be directly against the leaf spring, it would be difficult for the leaf spring to retreat out of the receptacle 13 when the latch elements 31 and 32 are squeezed together.

In view of the foregoing, it can be seen that the holder of the present invention provides a means for permitting an article of personal use to be detachably connected to the holder and when so connected, allows for swivelling. Furthermore, the latch mechanism provides for releasable attachment of the stud to the holder so that the stud may rotate or swivel in a latched position preventing removal of the stud from the holder even during the swivel operation or procedure.

While particular embodiments of the present invention have been shown and described, it will be obvious to those skilled in the art that changes and modifications may be made without departing from this invention in its broader aspects and, therefore, the air in the appended claims is to cover all such changes and modifications as fall within the true spirit and scope of this invention.

What is claimed is:

1. A releasable swivel holder for an article of personal use comprising:

a stud means adapted to be carried on the article;

a base member having an open receptacle for insertably receiving said stud means;

a resilient catch means movably carried on said base member adapted to selectively retain and release said stud means within said receptacle;

said catch means cooperating with said base member to permit pivoting of said stud means within said receptacle when said stud means is retained within said receptacle;

a latch means movably carried on said base member for releasing said catch means from retaining said stud means;

said catch means includes an elongated leaf spring integrally carried on said base member and having a catch disposed midway between its opposite ends and being selectably movable into and out of retaining engagement with said stud means;

said stud means includes a circular disk and said receptacle is partially circular to accept said circular disk;

said base member includes a slot accommodating said catch means leaf spring and said catch is yieldably disposed in said receptacle;

said latch means includes a pair of latch elements having sloping tips arranged in opposing and opposite spaced-apart relationship; and said leaf spring terminating in a wedge element disposed between said pair of latch element sloping tips whereby actuating said latch elements together engages said sloping tips on opposite sides of said wedge element to forcibly urge said leaf spring to disengage said catch from said disk.

2. The holder as defined in claim 1 wherein:

said disk includes a circular groove separating an upper plate from a lower plate; and said receptacle defined by a U-shaped flange adapted to reside in said groove of said disk.

3. The holder as defined in claim 2 wherein:

said base member includes an open-ended passage-way for insertably receiving a belt; and said base member further having spacer means separated by said slot permitting movement of said leaf spring in response to actuation by said latch means.

4. The holder as defined in claim 2 wherein:

said base member includes a pair of mounting slots separated by said leaf spring.

5. The holder as defined in claim 2 wherein:

said base member includes an eyelet useful in mounting said base member.

6. A holder comprising:

a base member having a rounded receptacle defined by a flange;

a disk having an undercut circular groove insertably receivable into said receptacle with said flange disposed in said groove;

resilient catch means movably mounted on said base member adapted to alternately engage and disengage with said disk within said receptacle;

latch means operably carried on said base member to move said catch means out of engagement with said disk;

said catch means includes an elongated leaf spring having a catch midway between its opposite ends and terminating in a wedge having sloping opposite sides;

said latch means includes a pair of latch elements separated by said wedge; and said latch elements terminating in slanted tips engageable with said sloping opposite sides in a compressive action forcibly urging said leaf spring to cause disengagement of said catch with said disk.

7. The holder as defined in claim 6 wherein:

said base member includes a pair of converging guide rails terminating at said receptacle for conducting said disk into said receptacle.

8. The holder as defined in claim 7 wherein:

said disk being in movable relationship with respect to said catch permitting rotation of said disk in said receptacle.

* * * * *